US011710416B2

(12) United States Patent
Huang et al.

(10) Patent No.: US 11,710,416 B2
(45) Date of Patent: Jul. 25, 2023

(54) MULTI-DIMENSIONAL FLIGHT RELEASE EFFICIENCY EVALUATION METHOD

(71) Applicant: THE 28TH RESEARCH INSTITUTE OF CHINA ELECTRONICS TECHNOLOGY GROUP CORPORATION, Nanjing (CN)

(72) Inventors: Jibo Huang, Nanjing (CN); Hui Ding, Nanjing (CN); Jing Tian, Nanjing (CN); Ming Tong, Nanjing (CN); Bin Dong, Nanjing (CN); Xuan Wang, Nanjing (CN); Xu Bao, Nanjing (CN); Xi Chen, Nanjing (CN)

(73) Assignee: THE 28TH RESEARCH INSTITUTE OF CHINA ELECTRONICS TECHNOLOGY GROUP CORPORATION, Nanjing (CN)

( * ) Notice: Subject to any disclaimer, the term of this patent is extended or adjusted under 35 U.S.C. 154(b) by 0 days.

(21) Appl. No.: 17/822,812

(22) Filed: Aug. 29, 2022

(65) Prior Publication Data

US 2023/0035944 A1 Feb. 2, 2023

Related U.S. Application Data

(63) Continuation of application No. PCT/CN2022/097769, filed on Jun. 9, 2022.

(51) Int. Cl.
*G08G 5/00* (2006.01)

(52) U.S. Cl.
CPC ..... *G08G 5/0095* (2013.01); *G08G 5/003* (2013.01); *G08G 5/0043* (2013.01); (Continued)

(58) Field of Classification Search
CPC .... G08G 5/0095; G08G 5/003; G08G 5/0043; G08G 5/0017; G08G 5/0026; G08G 5/0082
See application file for complete search history.

(56) References Cited

U.S. PATENT DOCUMENTS 3,088,107 A * 4/1963 Martienssen ..... G08G 5/0043 342/36
6,393,358 B1 * 5/2002 Erzberger ..... G08G 5/0043 701/122

(Continued)

FOREIGN PATENT DOCUMENTS

CN 103093650 A 5/2013
CN 103473469 A 12/2013

(Continued)

*Primary Examiner* — Dale W Hilgendorf
(74) *Attorney, Agent, or Firm* — CBM Patent Consulting, LLC

(57) ABSTRACT

A multi-dimensional flight release efficiency evaluation method. The method comprises: obtaining air flow control production and operation data which mainly comprises airspace capacity information, flight scheduling basic information, flight four-dimensional trajectory information and the like through a business information comprehensive processing platform, identifying a flight object affected by flow control and a flight object restricted by flow control through processing the operation data, analyzing a flight release time-hopping degree, calculating flight release delay distribution, evaluating controlled flight release fairness, predicting a controlled flight release normal rate, comparing airspace flow capacity matching situations, establishing a multi-dimensional flight release efficiency evaluation index set, and visually displaying evaluation indexes in modes of list, histogram, line chart, radar chart and the like.

1 Claim, 8 Drawing Sheets

(52) U.S. Cl.
CPC ..... *G08G 5/0017* (2013.01); *G08G 5/0026* (2013.01); *G08G 5/0082* (2013.01)

(56) References Cited

U.S. PATENT DOCUMENTS

| | | | | |
|---|---|---|---|---|
| 6,584,400 | B2 * | 6/2003 | Beardsworth | G08G 5/0095 701/120 |
| 7,248,963 | B2 * | 7/2007 | Baiada | G08G 5/0043 342/36 |
| 9,423,799 | B1 * | 8/2016 | Wu | G08G 5/0026 |
| 2010/0063716 | A1 * | 3/2010 | Brozat | G08G 5/0043 701/120 |
| 2022/0276055 | A1 * | 9/2022 | Candido | G05D 1/101 |
| 2022/0383759 | A1 * | 12/2022 | Chen | G08G 5/0026 |
| 2022/0392356 | A1 * | 12/2022 | Chen | G01C 21/20 |

FOREIGN PATENT DOCUMENTS

| | | | | | |
|---|---|---|---|---|---|
| CN | 104933530 | A | | 9/2015 | |
| CN | 109615163 | A | * | 4/2019 | G08G 5/003 |
| CN | 109741638 | A | | 5/2019 | |
| CN | 111160770 | A | * | 5/2020 | G08G 5/003 |
| CN | 113034980 | A | | 6/2021 | |
| EP | 2481039 | B1 | * | 11/2017 | G08G 5/0026 |
| GB | 2473692 | A | * | 3/2011 | G08G 5/0026 |

* cited by examiner

List of associated flights

| Flight call sign | Departure airport | Landing airport | Scheduled off-block time | Calculated off-block time | Calculated take off time | Departure region |
|---|---|---|---|---|---|---|
| CSN3999 | ZGGG | ZBAD | 1305 | 1305 | 1335 | Central and Southern China |
| CSC8843 | ZUUU | ZSNJ | 1430 | 1455 | 1525 | Southwest China |
| CES2111 | ZLXY | ZBAD | 1600 | 1625 | 1650 | Northwest China |
| CCA4383 | ZUUU | ZGSZ | 1630 | 1630 | 1700 | Southwest China |
| DKH1215 | ZSSS | ZLXY | 1455 | 1510 | 1540 | East China |
| CQH6545 | ZLLL | ZSHC | 1500 | 1550 | 1610 | Northwest China |
| CDG4089 | ZWWW | ZSHC | 1145 | 1230 | 1250 | Xinjiang |
| CSC8965 | ZSHC | ZSNJ | 1200 | 1200 | 1230 | East China |
| CSZ9630 | ZBAA | ZYTL | 935 | 955 | 1025 | Northwest China |
| CHH7386 | ZBTJ | ZPPP | 1015 | 1015 | 1035 | Northwest China |
| CSH9452 | ZUCK | ZGGG | 1140 | 1140 | 1200 | Southwest China |
| CCA1776 | ZYTX | ZSNJ | 1205 | 1235 | 1255 | Northwest China |

FIG. 2

| Region(number of flights) | L1 | L2 | L3 | L4 |
|---|---|---|---|---|
| Northeast China | 1 | 3 | 8 | 4 |
| Northwest China | 3 | 5 | 6 | 6 |
| Xinjiang | 0 | 1 | 5 | 3 |
| Southwest China | 2 | 4 | 10 | 8 |
| North China | 3 | 1 | 14 | 15 |
| East China | 0 | 2 | 18 | 12 |
| Central and Southern China | 0 | 2 | 20 | 10 |

| Region(number of flights) | Nomal flights | Abnomal flights |
|---|---|---|
| Northeast China | 82 | 10 |
| Northwest China | 90 | 8 |
| Xinjiang | 78 | 8 |
| Southwest China | 156 | 20 |
| North China | 180 | 25 |
| East China | 165 | 28 |
| Central and Southern China | 190 | 35 |

MULTI-DIMENSIONAL FLIGHT RELEASE EFFICIENCY EVALUATION METHOD

CROSS REFERENCES

This application is the U.S. continuation application of International Application No. PCT/CN2022/097769 filed on 9 Jun. 2022 which designated the U.S. and claims priority to Chinese Application No. CN202110869090.8 filed on 30 Jul. 2021, the entire contents of each of which are hereby incorporated by reference.

TECHNICAL FIELD

The present invention belongs to the field of air traffic control, and more particularly, relates to a multi-dimensional flight release efficiency evaluation method.

BACKGROUND

Aiming at the actual demand of orderly management of civil aviation air traffic operation, International Civil Aviation Organization has issued an aviation system block upgrade plan ASBU, and Civil Aviation Administration of China has issued a development and implementation strategy of aviation system block upgrade of China, both of which put forward a core management concept of adapting a flight flow to an airspace capacity, with a significance of balancing a flight demand and a service capability, thus achieving the purpose of easing air traffic congestion and alleviating flight delays through releasing and scheduling flights. Therefore, air traffic management bureaus at all levels have built corresponding flow management systems and collaborative release systems, which provide functions such as monitoring, prediction, analysis, decision-making, implementation and evaluation for each stage of air traffic operation focusing on how to scientifically and reasonably release flights, thus ensuring the safety, efficiency and economic operation of the flights.

Due to the high complexity and strong time-variability of a civil aviation operation environment, a flight release management decision is always in an iterative process of continuous updating and adaptation, so that how to evaluate and analyze a flight release scheme comprehensively, objectively, scientifically and reasonably has become the focus of current operation management. Existing related technical methods and application systems at home and abroad mainly focus on the prediction and analysis of a flight flow and a flight release delay, with single evaluation method and limited system functions. At present, there is still a lack of a multi-dimensional evaluation and analysis method and system for flight release efficiency.

SUMMARY

Object of the present invention: the technical problem to be solved by the present invention is to provide a multi-dimensional flight release efficiency evaluation method aiming at defects in a flight release effect evaluation technical method. In the method, civil aviation operation and production data are obtained through a data exchange platform, from perspectives such as a stability, an influence range, delay distribution and a fairness situation of flight release, a multi-dimensional flight release efficiency evaluation index set is constructed, which covers a macro overall operation effect and a micro regional efficiency evaluation method, so that indexes such as a hopping amount, a delay amount and a normal rate of flights are calculated and analyzed, and the evaluation indexes are visually displayed in modes of list, histogram, line chart, radar chart and the like.

Technical solution: in order to achieve the object of the present invention above, the present invention discloses a multi-dimensional flight release efficiency evaluation method, comprising the following steps of:

step 1: parsing and processing operation information such as an airspace capacity and a flight schedule;

step 2: identifying a flight object affected by flow control, a flight object restricted by flow control, and a flight object departing from each civil aviation control region according to flight scheduling information;

step 3: analyzing a matching situation between a flight flow and an airspace capacity of a designated airspace object comparatively;

step 4: taking the civil aviation control region as an object to analyze a release time-hopping situation of the flight departing from each control region, which comprises a hopping flight number and a hopping level;

step 5: taking the civil aviation control region as an object to analyze a distribution situation of release delays of the flight departing from each control region, which comprises a maximum delay, a minimum delay, a total delay, a delay flight number and an average delay;

step 6: taking the civil aviation control region as an object to analyze a normal release rate situation of the flight departing from each control region, which comprises a number of normal flights, a number of abnormal flights and a normal rate;

step 7: analyzing a fairness situation of the flight departing from the civil aviation control region, which comprises delay fairness, hopping fairness and fairness under restriction; and step 8: analyzing an overall release efficiency of the controlled flight, which comprises a delay type, a stability type and an affecting type. The delay type comprises: a total delay flight number, the total delay and the average delay; the stability type comprises: a total hopping flight number, a total hopping amount and an average hopping amount; and the affecting type comprises: a number of flights affected, a number of flights restricted, a ratio of flights restricted.

The step 1 comprises the following steps of:

step 1-1: parsing flight scheduling basic information (FlightInfo), which comprises a flight call sign (Callsign), a departure airport (DepAirport), a landing airport (DesAirport), a departure region (DepRegion), a scheduled off-block time (Sobt), a scheduled landing time (Sldt), a calculated off-block time (CurCobt) calculated by latest release, a calculated takeoff time (CurCtot) calculated by latest release, a calculated off-block time (LastCobt) calculated by last release, a calculated takeoff time (LastCtot) calculated by last release, a label (Affected) of flight affected by flow control, and a label (Restricted) of flight restricted by flow control; and recording comprehensive information of an $i^{th}$ flight as $FlightInfo_i$;

step 1-2: parsing flight four-dimensional trajectory information $Flight4DT=\{CrossAirsapce_1, \ldots, CrossAirsapce_j\}$, wherein $CrossAirsapce_j$ is a $j^{th}$ airspace object that the flight passes through, which comprises a name ($AirsapceName_j$) of the airspace object that the flight passes through and a time ($EntreTime_j$) of entering the airspace; and recording the comprehensive information of the $i^{th}$ flight as $Flight4DT_i$; and step 1-3: parsing capacity information (Capacity) of an airspace object needing to be evaluated, which comprises a name (Airsapce) of the airspace object and an airspace capacity (Capacity).

The step 2 comprises the following steps of:

step 2-1: traversing each flight scheduling basic information (FlightInfo);

step 2-2: when the DepRegion in the traversed flight scheduling basic information is Xinjiang, identifying the flight as a flight object departing from a Xinjiang control region, and putting the flight into a flight set ($FlightSet_1$) departing from the Xinjiang control region; when the DepRegion is Northeast China, identifying the flight as a flight object departing from a northeast control region, and putting the flight into a flight set ($FlightSet_2$) departing from the northeast control region; when the DepRegion is Northwest China, identifying the flight as a flight object departing from a northwest control region, and putting the flight into a flight set ($FlightSet_3$) departing from the northwest control region; when the DepRegion is Southwest China, identifying the flight as a flight object departing from a southwest control region, and putting the flight into a flight set ($FlightSet_4$) departing from the southwest control region; when the DepRegion is East China, identifying the flight as a flight object departing from an East China control region, and putting the flight into a flight set ($FlightSet_5$) departing from the East China control region; when the DepRegion is North China, identifying the flight as a flight object departing from a North China control region, and putting the flight into a flight set ($FlightSet_6$) departing from the North China control region; and when the DepRegion is Central and Southern China, identifying the flight as a flight object departing from a Central and Southern China control region, and putting the flight into a flight set ($FlightSet_7$) departing from the Central and Southern China control region;

step 2-3: traversing a flight set ($FlightSet_i$) departing from the control region, wherein a value of i ranges from 1 to 7;

step 2-4: traversing every flight information ($FlightInfo_j$) in the $FlightSet_5$, wherein a value of j ranges from 1 to $N_i$, and $N_i$ represents a total number of flights departing from a corresponding control region;

step 2-5: when the label (Affected) of flight affected by flow control is equal to 1, identifying the flight as the flight object affected by flow control; and when the label (Restricted) of flight restricted by flow control is equal to 1, identifying the flight as the flight object restricted by flow control;

step 2-6: calculating a number ($AffectedNum_i$) of flights departing from the corresponding control region and affected by flow control, wherein when the label (Affected) of flight affected by flow control is equal to 1, $AffectedNum_i$=$AffectedNum_i$+1, and putting the flight information into a flight set (AffectedSet) affected by flow control; and step 2-7: calculating a number ($RestrictedNum_i$) of flights departing from the corresponding control region and restricted by flow control, wherein when the label (Restricted) of flight restricted by flow control is equal to 1, $RestrictedNum_i$=$RestrictedNum_i$+1, and putting the flight information into a flight set RestrictedSet restricted by flow control.

The step 3 comprises the following steps of:

step 3-1: parsing set evaluation parameters, which comprise the name (Airsapce) of the evaluated airspace object, an evaluation beginning time (BgnTime), an evaluation time span (TimeSpan), and a number (TimeNum) of evaluation time periods;

step 3-2: dividing the evaluation time periods to generate continuous evaluation time slices, and putting the evaluation time slices into an evaluation time slice set TimeSpanSet={$BT_1$,$ET_1$), . . . , $BT_1$,ET)}, ia??[1, TimeNum], wherein $BT_i$=Bgn Time+TimeSpan*(i−1) represents a beginning time of an $i^{th}$ evaluation time slice; and ET=BgnTime+TimeSpan*i represents an ending time of the $i^{th}$ evaluation time slice;

step 3-3: extracting time period capacity information of the airspace object needing to be evaluated from the parsed capacity information (Capacity) of the airspace object needing to be evaluated to obtain an airspace capacity ($C_i$) of the $i^{th}$ time slice;

step 3-4: traversing $CrossAirsapce_j$ in the flight four-dimensional trajectory information;

step 3-5: whenAirsapceName=Airsapce, allowing that $EntreTime_j$a??$BT_i$,$ET_i$), which represents that the name of the airspace object that the flight passes through is the same as the airspace object needing to be evaluated, and when the time of entering the airspace is within beginning and ending time periods of the time slice, allowing that $Flow_i$=$Flow_i$+1, wherein $Flow_i$ represents a predicted flow of the $i^{th}$ evaluation time slice; and step 3-6: after obtaining the predicted airspace flow of each time slice, comparing a matching situation between the predicted flow and the airspace capacity, and calculating an overflow operation level ($OverFlowLv_i$) of each time slice, wherein:

$$OverFlowLv_i = \begin{cases} -1,\ Flow_i \in -\infty, 0.8*C_i) \text{ and } C_i \neq 0 \\ 0,\ Flow_i \in 0.8*C_i, C_i) \text{ and } C_i \neq 0 \\ 1,\ Flow_i \in C_i, 1.1*C_i) \text{ and } C_i \neq 0 \\ 2,\ Flow_i \in 1.1*C_i, 1.2*C_i) \text{ and } C_i \neq 0 \\ 3,\ Flow_i \in 1.2*C_i, +\infty) \text{ and } C_i \neq 0 \\ \Phi, \text{others} \end{cases}.$$

The step 4 comprises the following steps of:

step 4-1: traversing the flight set ($FlightSet_i$) departing from each civil aviation control region;

step 4-2: traversing every flight information ($FlightInfo_j$) in the $FlightSet_i$;

step 4-3: when the flight satisfies that CurCtot−LastCtot∈(−∞,−$VSP_1$], allowing that $ChangeLv1Num_i$=$ChangeLv1Num_i$+1; when the flight satisfies that CurCtot−LastCtot∈(−$VSP_1$,0), allowing that $ChangeLv2Num_i$=$ChangeLv2Num_i$+1; when the flight satisfies that CurCtot−LastCtot∈(0,$VSP_1$], allowing that $ChangeLv3Num_i$=$ChangeLv3Num_i$+1; and when the flight satisfies that CurCtot−LastCtot∈($VSP_1$,+∞), allowing that $ChangeLv4Num_i$=$ChangeLv1Num_i$+1; wherein CurCtot−LastCtot represents a difference of calculated takeoff time calculated by two latest releases (which is namely the flight hopping amount), $ChangeLv1Num_i$ represents a number of flights with a hopping level 1 of the $i^{th}$ control region, $ChangeLv2Num_i$ represents a number of flights with a hopping level 2 of the $i^{th}$ control region, $ChangeLv3Num_i$ represents a number of flights with a hopping level 3 of the $i^{th}$ control region, $ChangeLv4Num_i$ represents a number of flights with a hopping level 4 of the $i^{th}$ control region, and $VSP_I$ represents a hopping level interval threshold (in a unit of minute);

step 4-4: calculating a total hopping number ($ChangeNum_i$) of the flights departing from the corresponding control region, wherein $ChangeNum_i$=$ChangeLv1Num_i$+$ChangeLv2Num_i$+$ChangeLv3Num_i$+$ChangeLv4Num_i$; and step 4-5: calculating a total hopping amount ($ChangeTotal_i$) of the flights departing from the corresponding control region, wherein $$ChangeTotal_i = \sum_{j=1}^{N_i} |CurCtot - LastCtot|.$$

The step 5 comprises the following steps of:

step 5-1: traversing the flight set ($FlightSet_i$) departing from each civil aviation control region;

step 5-2: traversing every flight information ($FlightInfo_j$) in the $FlightSet_i$;

step 5-3: calculating a delay number ($DelayNum_i$) of the flights of the corresponding control region, wherein when $CurCobt_j - Sobt_j > 0$, $DelayNum_i = DelayNum_i + 1$, which represents that when the calculated off-block time of the flight departing from the control region is greater than the scheduled off-block time, the flight is a delayed flight of the control region, and $CurCobt_j - Sobt_j$ represents a delay amount of the flight;

step 5-4: initializing that $DelayMax_i = 0$, and calculating a maximum delay ($DelayMax_i$) of the flights of the corresponding control region, wherein when $CurCobt_j - Sobt_j > DelayMax_i$, $DelayMax_i = CurCobt_j - Sobt$, which is also denoted as:

$$DelayMax_i = MAX(DelayMax_i, CurCobt_j - Sobt_j, 0);$$

step 5-5: initializing that $DelayMin_i = 0$, and calculating a minimum delay ($DelayMin_i$) of the flights of the corresponding control region, wherein when $CurCobt_j - Sobt_j < DelayMin_i$, $DelayMin_i = CurCobt_j - Sobt$, which is also denoted as:

$$DelayMin_i = Min(DelayMin_i, Max(CurCobt_j - Sobt_j, 0));$$

step 5-6: calculating a total delay ($DelayTotal_i$) of the flights of the corresponding control region, which represents a sum of delays of the flights of the control region, wherein:

$$DelayTotal_i = \sum_{j=1}^{N_i} MAX(CurCobt_j - Sobt_j, 0);$$

and step 5-7: calculating an average delay ($DelayAve_i$) of the flights of the corresponding control region, which represents an average delay amount of the flights of the control region, wherein:

$$DelayAve_i = \begin{cases} DelayTotal_i / DelayNum_i, & DelayNum_i \neq 0 \\ 0, & DelayNum_i = 0 \end{cases}.$$

The step 6 comprises the following steps of:

step 6-1: traversing the flight set ($FlightSet_i$) departing from each civil aviation control region;

step 6-2: traversing every flight information ($FlightInfo_j$) in the $FlightSet_i$;

step 6-3: calculating a number ($NormalNum_i$) of normal flights departing from the $i^{th}$ control region, wherein when $CurCobt_j - Sobt_j \in (-\infty, VSP_2)$, $NormalNum_i = NormalNum_i + 1$, which represents that flights with a flight delay no greater than $VSP_2$ are the normal flights;

step 6-4: calculating a number ($UnNormalNum_i$) of abnormal flights, wherein when $CurCobt_j - Sobt_j \in (VSP_2, +\infty)$, $UnNormalNum_i = UnNormalNum_i + 1$, which represents that flights with a flight delay greater than $VSP_2$ are the abnormal flights; and step 6-5: after finishing traversing the flights, calculating a normal rate ($NormalRate_i$) of the flights departing from the corresponding control region, which represents a ratio of the normal flights in the flights departing from the control region, wherein $NormalRate_i = NormalNum_i / N_i$.

The step 7 comprises the following steps of:

step 7-1: calculating an average value (DelayAveAve) of the average delays of the flights departing from each control region, wherein:

$$DelayAveAve = \sum_{i=1}^{7} DelayAve_i / 7;$$

step 7-2: calculating a delay fairness index (DelayFairness), which represents a standard deviation of the average delay of the flights departing from each control region, wherein:

$$DelayFairness = \sqrt{\sum_{i=1}^{7} (DelayAve_i - DelayAveAve)^2 / 6};$$

step 7-3: calculating an average hopping amount (ChangeAve) of the flights departing from each control region, wherein:

$$ChangeAve = \sum_{i=1}^{7} ChangeTotal_i / 7;$$

step 7-4: calculating a hopping fairness index (ChangeFairness), which represents a standard deviation of the hopping amount of the flights departing from each control region, wherein:

$$ChangeFairness = \sqrt{\sum_{i=1}^{7} (ChangeTotal_i - ChangeAve)^2 / 6};$$

step 7-5: calculating an average number (RestrictedAve) of the flights departing from each control region and restricted by flow control, wherein:

$$RestrictedAve = \sum_{i=1}^{7} RestrictedNum_i / 7;$$

and step 7-6: calculating a restricted fairness index (RestrictedFairness), which represents a standard deviation of the number of the flights departing from each control region and restricted by flow control, wherein:

$$RestrictedFairness = \sqrt{\sum_{i=1}^{7} (RestrictedNum_i - RestrictedAve)^2 / 6}.$$

The step 8 comprises the following steps of:

step 8-1: calculating a total hopping flight number (ChangeNum), which represents a number of flights in all flights with different calculated off-block time calculated by two adjacent releases, wherein $$ChangeNum = \sum_{i=1}^{7} ChangeNum_i;$$

step 8-2: calculating a total hopping amount (ChangeTotal) of the flights, which represents a cumulative absolute difference of the calculated off-block time calculated by two adjacent releases of all flights, wherein $$ChangeNum = \sum_{i=1}^{7} ChangeTotal_i;$$

step 8-3: calculating an average hopping amount (ChangeTotalAve) of the flights, which represents an average absolute difference of the calculated off-block time calculated by two adjacent releases of all flights, wherein:

$$ChangeTotalAve = \begin{cases} ChangeTotal/ChangeNum, & ChangeNum \neq 0 \\ 0, & ChangeNum = 0 \end{cases};$$

step 8-4: calculating a total delay flight number (DelayNum), which represents a number of flights in all flights with the calculated off-block time later than the scheduled off-block time, wherein $$DelayNum = \sum_{i=1}^{7} DelayNum_i;$$

step 8-5: calculating a total delay amount (DelayTotal) of the flights, which represents a cumulative absolute difference of all flights with the calculated off-block time later than the scheduled off-block time, wherein $$DelayTotal = \sum_{i=1}^{7} DelayTotal_i;$$

step 8-6: calculating an average delay amount (DelayTotalAve) of the flights, which represents an average difference of all flights with the calculated off-block time later than the scheduled off-block time, wherein:

$$DelayTotalAve = \begin{cases} DelayTotal/DelayNum, & DelayNum \neq 0 \\ 0, & DelayNum = 0 \end{cases};$$

step 8-7: calculating a total number (AffectedNum) of flights affected, which represents a number of flights affected by flow control, wherein:

$$AffectedNum = \sum_{i=1}^{7} AffectedNum_i;$$

step 8-8: calculating a total number (RestrictedNum) of flights restricted, which represents a number of flights restricted by flow control, wherein:

$$RestrictedNum = \sum_{i=1}^{7} RestrictedNum_i;$$

step 8-9: calculating a ratio (RestrictedRato) of flights restricted, which represents a ratio of flights restricted by flow control, wherein:

$$RestrictedRato = RestrictedNum/\sum_{i=1}^{7} N_i;$$

and step 8-10: normalizing the total hopping flight number (ChangeNum), the total hopping amount (ChangeTotal) of the flights, the average jumping amount (ChangeTotalAve) of the flights, the total delay flight number (DelayNum), the total delay amount (DelayTotal) of the flights, the average delay amount (DelayTotalAve) of the flights, the total number (AffectedNum) of the flights affected, the total number (RestrictedNum) of the flights restricted and the ratio (RestrictedRato) of the flights restricted, and analyzing an overall efficiency index by using a radar chart. The normalization is a way to simplify calculation, which means that a dimensional expression is converted into a dimensionless expression, and the evaluation values above are converted into ratios herein.

Results of the flight release efficiency evaluation indexes are displayed in modes of various graphs. The flight object restricted by flow control is displayed in a mode of list, the matching situation between the airspace flow and the capacity is displayed in superposed modes of histogram and line chart, the flight hopping level index is displayed in superposed modes of circular histogram and table, the flight delay distribution index is displayed in superposed modes of histogram and line segment, the flight fairness index is displayed in a mode of card, the flight normality index is displayed in superposed modes of histogram and table, and the overall efficiency index is displayed in a mode of radar chart.

The multi-dimensional flight release efficiency evaluation method of the present invention is loaded and operated in a processing server of an air traffic flow management system (ATFM system) or a corresponding computer of an air traffic control system (ATC system).

Beneficial effects: the significant advantages of the present invention comprise that:

1. a digital evaluation index set is provided for ensuring air traffic operation;
2. a multi-dimensional efficiency evaluation method is provided for flight release management;

3. an index result visual display ability is improved, and a multi-element combination mode is used to increase intuition and comprehensiveness; and
4. a strong support is provided for technical research and system development of flight release decision.

BRIEF DESCRIPTION OF THE DRAWINGS

The advantages of the above and/or other aspects of the present invention will become more apparent by further explaining the present invention with reference to the following drawings and detailed description.

FIG. 2 is a schematic diagram of an information list of flights restricted by flow control.

DETAILED DESCRIPTION

Embodiment

In the embodiment, dates of relevant time information are all Jul. 6, 2021, and in order to obtain production and operation data, a comprehensive operation information interaction platform is constructed firstly to parse basic information of a flight plan, flight four-dimensional trajectory prediction information and airspace capacity information. According to the needs of operation and management, airspace objects needing to be concerned may be configured, and a beginning time of concerning, a time granularity and a number of time periods are set. A flight object restricted by flow control is identified. A flight flow state of the configured airspace is predicted, and a matching situation between the flight flow and the capacity and an overflow level are analyzed. Calculation results of last two flight releases are compared, and hopping situations of the results of the flight releases, and a hopping flight number and a hopping level are analyzed. A delay distribution situation of flight release, and a maximum/minimum delay, a delay flight number and an average delay are analyzed. A normality situation of flight release, and a number of normal flights, a number of abnormal flights and a ratio of normal flights are evaluated. A fairness situation of flight release is evaluated, and hopping fairness, delay fairness and fairness under restriction are analyzed. Overall efficiency indexes of flight release are calculated from different aspects, and comprehensively evaluated by a normalization method.

With reference to FIG. 1 to FIG. 8, processing flow steps of a flight release efficiency evaluation method based on the method of the present invention are described in detail below.

Figure 1:
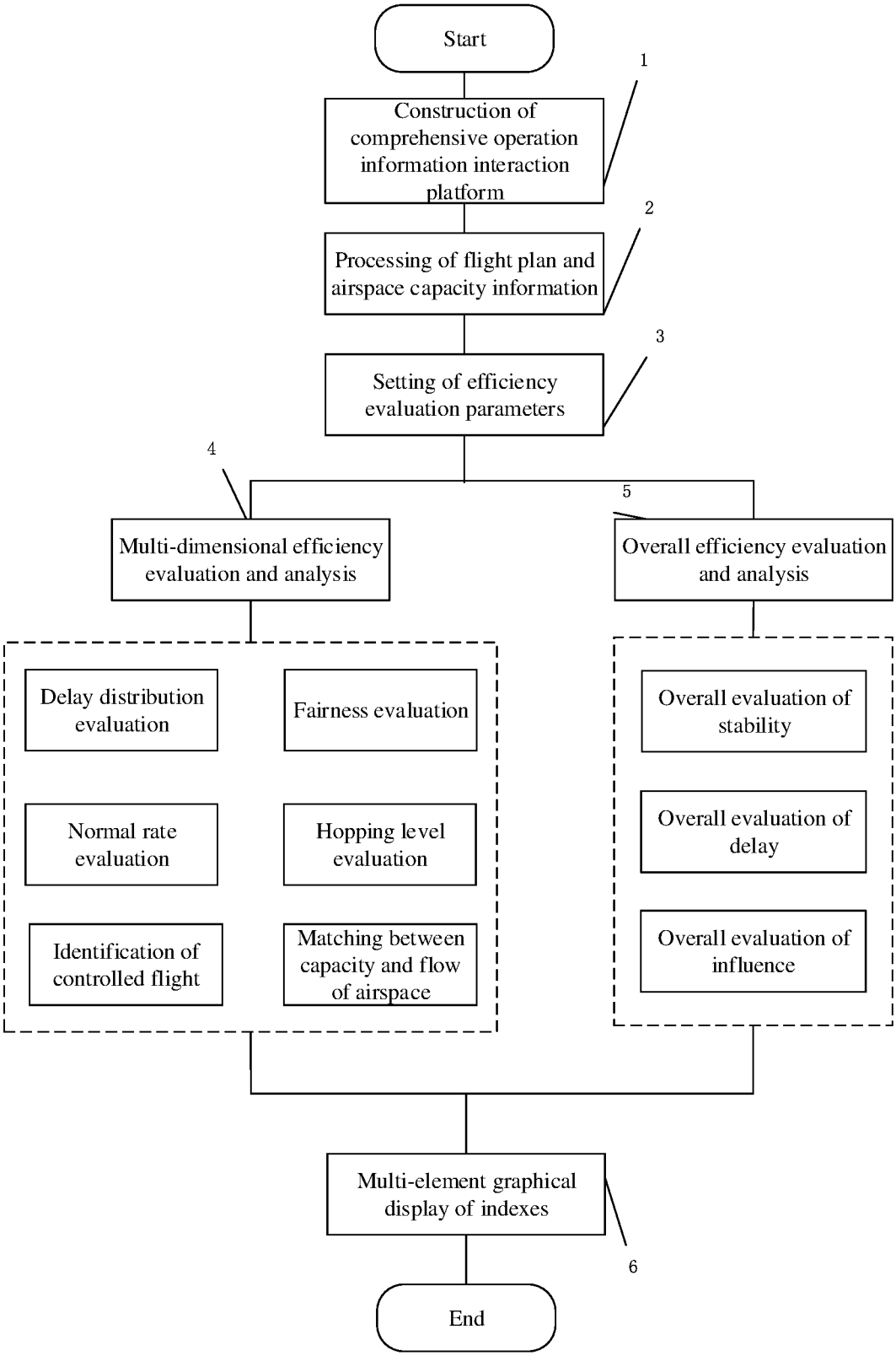
FIG. 1 is a flow chart of a predictive analysis method for an airport capacity and demand balance.

1. Obtaining of Comprehensive Operation Information 1-1: Processing of Basic Information of Flight Plan As shown in FIG. 1, the step 1 Construction of comprehensive operation information interaction platform: the basic information of the flight plan is obtained and parsed through the comprehensive operation information interaction platform, which mainly comprises: a flight call sign, a departure airport, a landing airport, a scheduled off-block time, a calculated off-block time, a calculated takeoff time, a departure region, a label of flight affected by flow control and a label of flight restricted by flow control. For example, details of basic information of a certain flight plan are: CSN3999, ZGGG, ZBAA, 13: 05, 13: 05, 13: 35, Central and Southern China, 1, 1.

1-2: Processing of Flight Four-Dimensional Trajectory Prediction Information

As shown in FIG. 1, the four-dimensional flight trajectory prediction information is obtained and parsed, which is an airspace object set that flights pass through, and comprises: a name of the airspace object that the flight passes through and a time of entering the airspace For example, details of four-dimensional trajectory prediction information of a flight CSZ1156 are: ZBAA, 08: 15; ZBACC02, 08: 21; . . . ; ZSNJ, 10: 45.

1-3: Processing of Airspace Capacity Information

As shown in FIG. 1, the step 2 processing of flight plan and airspace capacity information: the airspace capacity information is obtained and parsed, which comprises: a name of the airspace object, a capacity beginning time, a capacity ending time, a time granularity of capacity and a capacity value. For example, details of capacity information of an airspace ZBACC10 are: 08: 00, 09: 00, 60 minutes, 40; 09: 00, 12: 00, 60 minutes, 30; 12: 00, 14: 00, 60 minutes, 35; 14: 00, 16: 00, 60 minutes, 40.

2. Setting of Efficiency Evaluation Parameters

As shown in FIG. 1, the step 3 Setting of efficiency evaluation parameters: according to the needs of operation and management, basic parameter information needed by efficiency evaluation is set, which comprises: a name (Airsapce) of the evaluated airspace object, an evaluation beginning time (BgnTime), an evaluation time span (TimeSpan), a number (TimeNum) of evaluation time periods, a hopping level interval threshold $VSP_1$ and a normal flight delay threshold $VSP_2$. For example, details of efficiency evaluation parameters in certain setting are: ZBACC10, 08: 00, 60 minutes, 8, 15 minutes, 15 minutes.

As shown in FIG. 1, the step 4 Multi-dimensional efficiency evaluation and analysis Includes the following 3 to 8: 3. Analysis of flight restricted by flow control and graphical display; 4. Analysis of matching between capacity and flow, and graphical display; 5. Analysis of flight hopping and graphical display; 6. Analysis of delay distribution and graphical display; 7. Analysis of fairness and graphical display; 8. Analysis of normality and graphical display.

3. Analysis of Flight Restricted by Flow Control and Graphical Display

As shown in FIG. 2, according to the label of flight restricted by flow control in the basic information of the flight plan, the flight restricted by flow control is identified, which comprises the flight call sign, the departure airport, the landing airport, the scheduled off-block time, the calculated off-block time, the calculated takeoff time and the departure region, and the indexes are displayed in a mode of list. For example, details of one flight restricted by flow control are shown: CSN3999, ZGGG, ZBAA, 13: 05, 13: 05, 13: 35, Central and Southern China.

Figure 3:
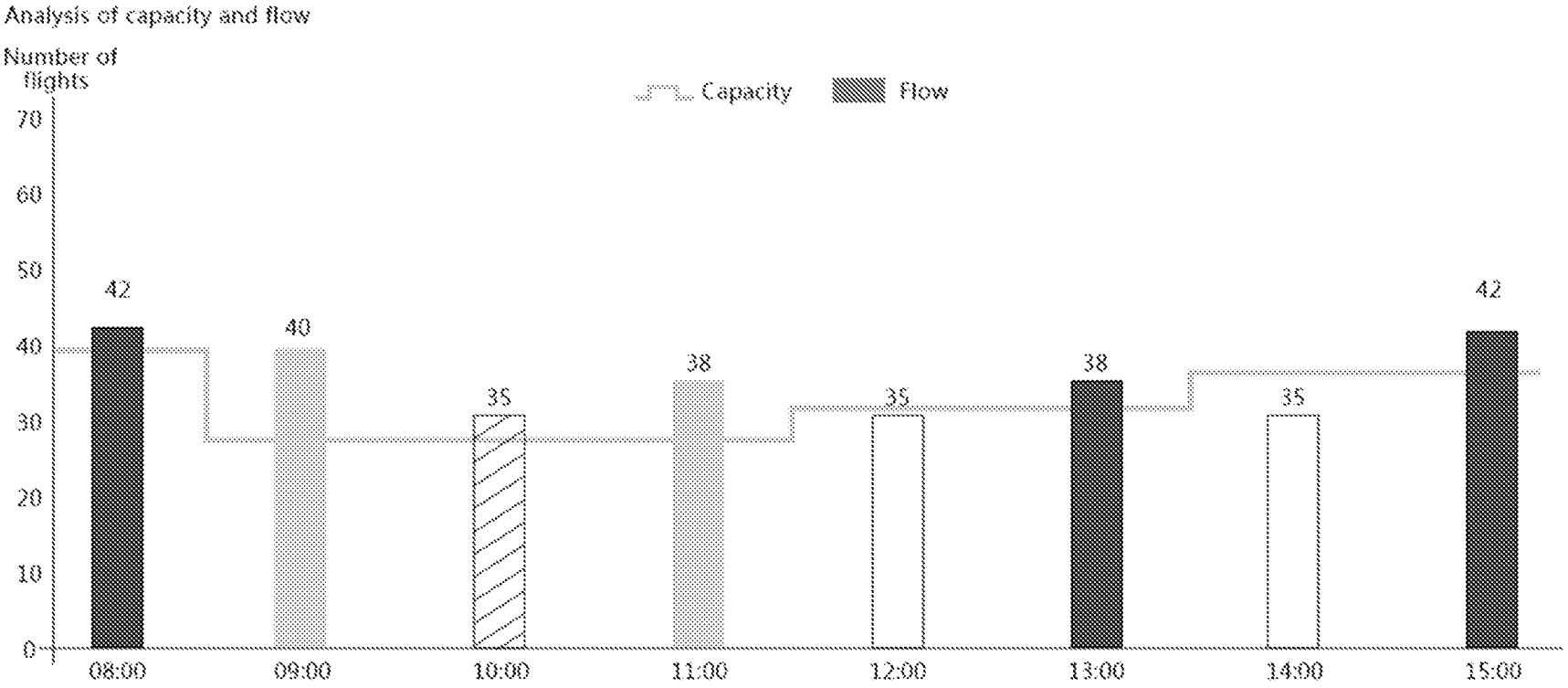
FIG. 3 is a schematic diagram of analysis of matching between airspace flight flow and capacity.

4. Analysis of Matching Between Capacity and Flow, and Graphical Display 4-1. Division of Time Slices As shown in FIG. 3, according to the set efficiency evaluation parameters, a time period of concerning of the airspace object is divided into several continuous time slices, and information of a single time slice comprises: a time slice beginning time and a time slice ending time. For example, details of a set of divided time slices are: 08: 00-09: 00, . . . , 12: 00-13: 00, . . . , 15: 00-16: 00.

4-2: Division of Airspace Capacity

As shown in FIG. 3, according to the information of the divided time slices, a time slice capacity is extracted from the airspace capacity information, which comprises: the capacity beginning time, the capacity ending time and the capacity value, and the indexes are displayed in a mode of broken line. For example, time slice capacity information of the airspace ZBACC10 is shown: 08: 00-09: 00, 40 flights; . . . ; 12: 00-13: 00, 35 flights; . . . ; and 15: 00-16: 00, 40 flights.

4-3. Prediction of Flight Flow

As shown in FIG. 3, according to the information of the divided time slices and the flight four-dimensional trajectory information, a flight flow of the concerned airspace that the flights pass through in the time slice is predicted, which comprises: a prediction beginning time, a prediction ending time and a predicted flow value, and the indexes are displayed in a mode of histogram. For example, a set of flight flow prediction information of the airspace ZBACC10 is shown: 08: 00-09: 00, 42 flights; . . . ; 12: 00-13: 00, 35 flights; . . . ; 14: 00-15: 00, 42 flights.

4-4. Analysis of Matching Between Capacity and Flow

As shown in FIG. 3, according to the time slice capacity information and the flow prediction information, an overflow level of each time slice is distinctively shown by filled colors of the flow prediction histogram: an overflow level 0 (Not shown in the figure), an overflow level 1 shows white, an overflow level 2 shows black, an overflow level 3 shows oblique line, and an overflow level 4 shows grey. For example, a set of information of matching between capacity and flow of the airspace ZBACC10 is shown: 08: 00-09: 00, overflow level 2, black flow histogram; . . . ; 12: 00-13: 00, overflow level 1, white flow histogram; . . . ; 15: 00-16: 00, overflow level 2, oblique line flow histogram.

5. Analysis of Flight Hopping and Graphical Display 5-1. Histogram Analysis of Hopping As shown in the left area of FIG. 4, calculated off-block time of latest two flight releases is compared, and a hopping situation of flights departing from each control region is analyzed, which comprises: an involved control region, a hopping flight number and a hopping level, and the indexes are respectively displayed in a mode of circular histogram. The hopping flight numbers with different hopping levels are distinctively shown by filled colors of the histogram: a hopping level 1 shows black, a hopping level 2 shows grey, a hopping level 3 shows oblique line, and a hopping level 4 shows dots. For example, a hopping situation of a North China control region is sown: the hopping level 1 is the innermost histogram, and the hopping level 4 is the outermost histogram.

5-2. Table Analysis of Hopping

Figure 4:
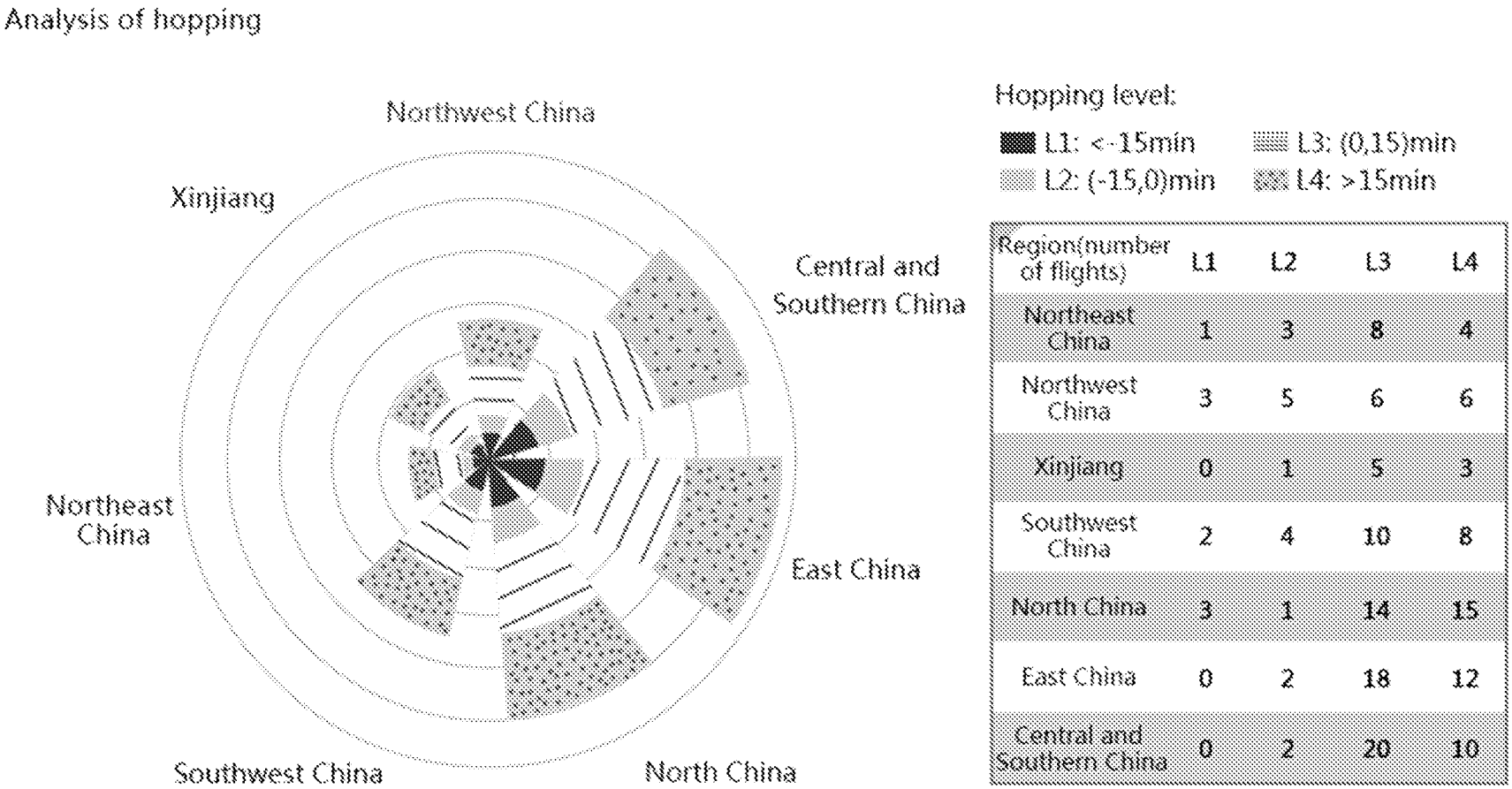
FIG. 4 is a schematic diagram of analysis of a hopping level of flight release.

As shown in the right area of FIG. 4, the hopping situation of flights departing from each control region is displayed in a mode of table, which comprises: the involved control region, the hopping flight number and the hopping level. For example, the hopping situation of the North China control region is shown: there are 3 flights in the hopping level 1, there is 1 flight in the hopping level 2, there are 14 flights in the hopping level 3, and there are 15 flights in the hopping level 4.

6. Analysis of Delay Distribution and Graphical Display 6-1. Analysis of Characteristic Delay Distribution As shown in the upper area of FIG. 5, a characteristic delay distribution situation of flights departing from each control region is analyzed, which comprises: an involved control region, a maximum delay, a minimum delay and an average delay. The maximum delay and the minimum delay are displayed in a mode of top/bottom of histogram, and the average delay is displayed in a mode of line segment. For example, characteristic delay distribution information of a Central and Southern China control region is shown: the maximum delay is 50 minutes, the minimum delay is 0 minute and the average delay is 22 minutes.

6-2. Analysis of Overall Delay Distribution

Figure 5:
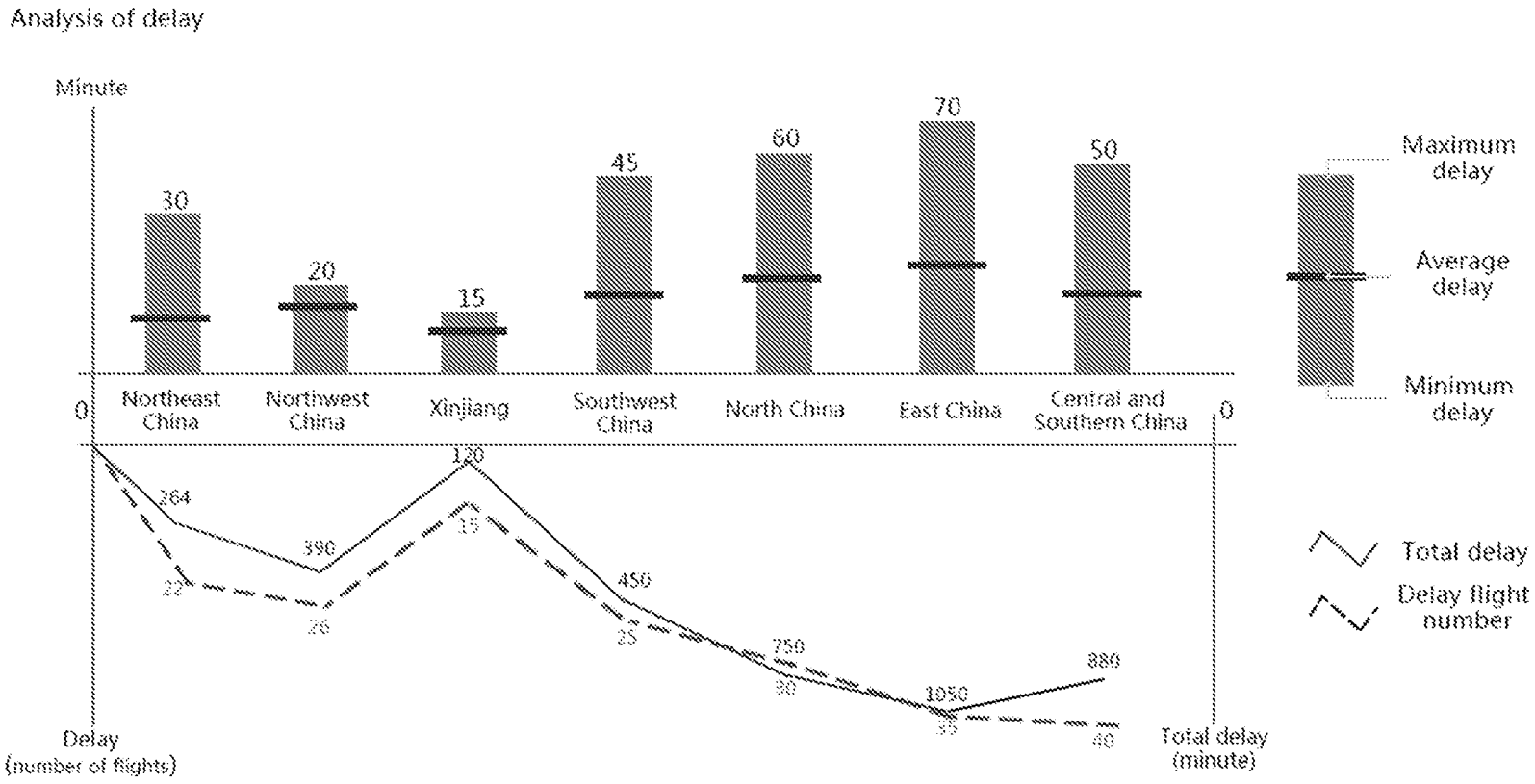
FIG. 5 is a schematic diagram of analysis of delay distribution of flight release.

As shown in the lower area of FIG. 5, an overall delay distribution situation of flights departing from each control region is analyzed, which comprises: the involved control region, a total delay and a total delay flight number, and the indexes are displayed in a mode of left and right biaxial broken lines. For example, overall delay distribution information of the Central and Southern China control region is shown: the total delay is 40 minutes, and the total delay flight number is 880.

7. Analysis of Fairness and Graphical Display 7-1. Analysis of Delay Fairness

Figure 6:
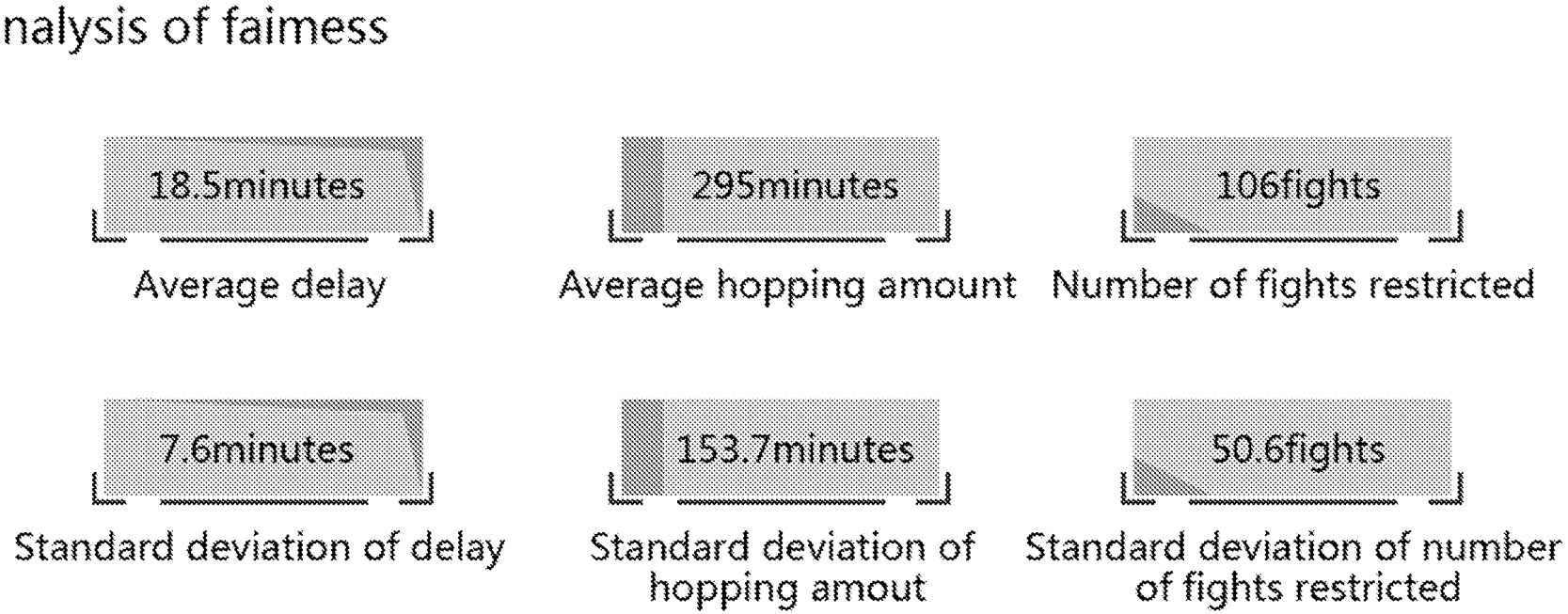
FIG. 6 is a schematic diagram of analysis of fairness of flight release.

As shown in the left column of FIG. 6, a delay fairness situation of flights is analyzed, which comprises: an average value of an average delay of the control region and a standard deviation of the average delay of the control region, and the indexes are displayed in a mode of card. For example, a set of delay fairness indexes is shown: the average delay of the control region is 18.5 minutes and the standard deviation of the average delay of the control region is 7.6 minutes.

7-2. Analysis of Hopping Fairness

As shown in the middle column of FIG. 6, a hopping fairness situation of flights is analyzed, which comprises: average hopping of the control region and a standard deviation of hopping of the control region, and the indexes are displayed in a mode of card. For example, a set of hopping fairness indexes is shown: the average hopping of the control region is 295 minutes and the standard deviation of hopping of the control region is 153.7 minutes.

7-3. Analysis of Fairness Under Restriction

As shown in the right column of FIG. 6, a fairness situation of flights restricted is analyzed, which comprises: an average number of flights restricted by flow control of the control region and a standard deviation of a number of flights restricted by flow control of the control region, and the indexes are displayed in a mode of card. For example, a set of indexes of the fairness under restriction is shown: the average number of flights restricted by flow control of the control region is 106 and the standard deviation of the number of flights restricted by flow control of the control region is 50.6.

8. Analysis of Normality and Graphical Display 8-1. Histogram Analysis of Normality As shown in the left area of FIG. 7, a normality situation of flights departing from each control region is analyzed, which comprises: an involved control region and a normal rate, and the indexes are displayed in a mode of histogram. For example, a normality index of East China is shown: the normal rate is 85.49%.

8-2. Table Analysis of Normality

Figure 7:
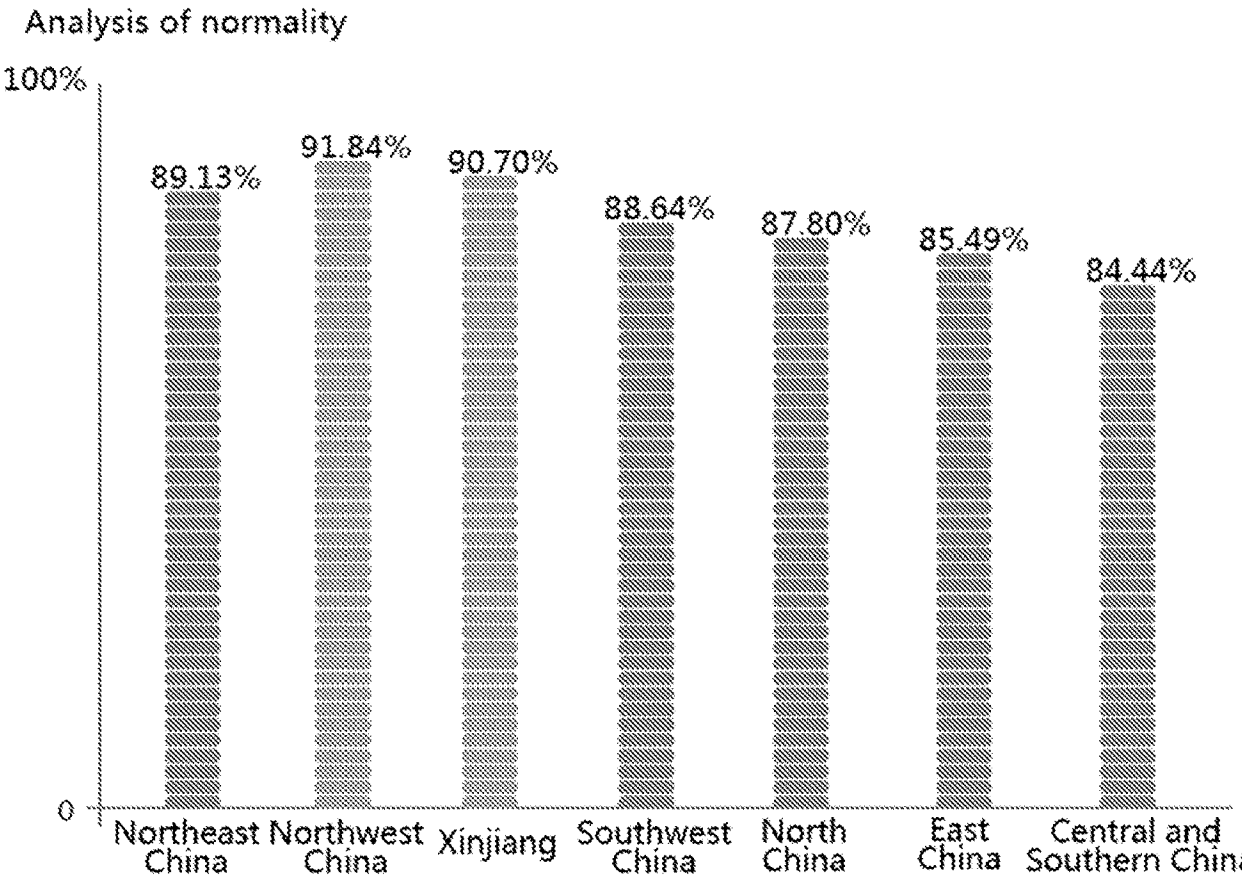
FIG. 7 is a schematic diagram of analysis of normality of flight release.

As shown in the right area of FIG. 7, the normality situation of flights departing from each control region is analyzed, which comprises: the involved control region, a number of normal flights, a number of abnormal flights and the normal rate, and the indexes are displayed in a mode of table. For example, normality indexes of East China are shown: the number of normal flights is 165, the number of abnormal flights is 28 and the normal rate is 85.49%.

9. Analysis of Overall Efficiency and Graphical Display

As shown in the step 5 of FIG. 4, Overall efficiency evaluation and analysis includes the following 9-1 to 9-3.

9-1. Analysis of Stability-Type Overall Efficiency

Figure 8:
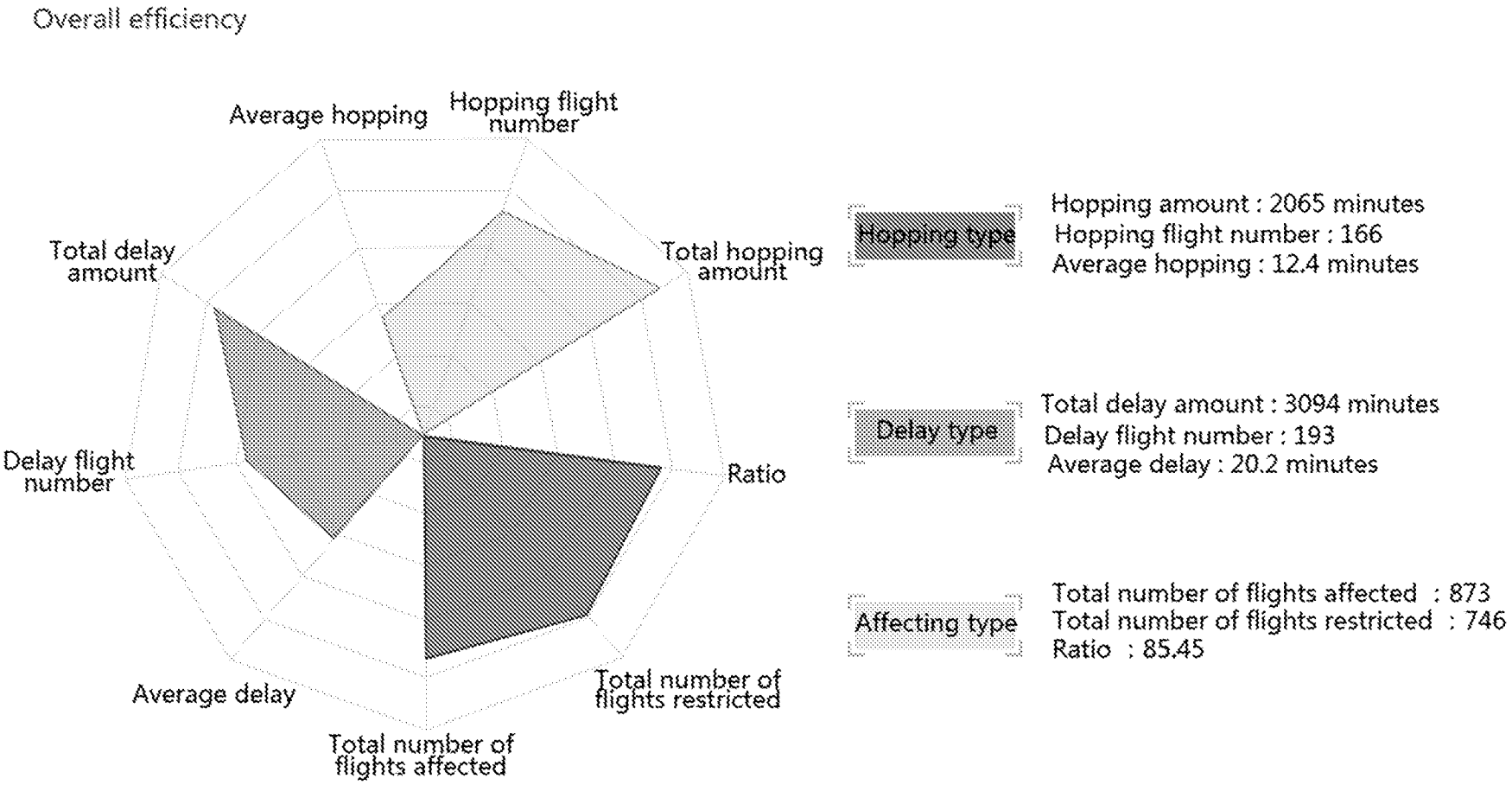
FIG. 8 is a schematic diagram of analysis of overall efficiency of flight release.

As shown in the right area of FIG. 8, an overall stability situation of flight release is analyzed, which comprises: a total hopping flight number, a total hopping amount and an average hopping amount, and the indexes are displayed in a mode of table. For example, a set of stability-type overall efficiency indexes is shown: the total hopping flight number is 2,065, the total hopping amount is 166 minutes and the average hopping amount is 12.4 minutes.

9-2. Analysis of Delay-Type Overall Efficiency

As shown in the right area of FIG. 8, an overall delay situation of flight release is analyzed, which comprises: a total delay flight number, a total delay amount and an average delay amount, and the indexes are displayed in a mode of table. For example, a set of delay-type overall efficiency indexes is shown: the total delay flight number is 193, the total delay amount is 3,904 minutes and the average delay amount is 20.2 minutes.

9-3. Analysis of Influence-Type Overall Efficiency

As shown in the right area of FIG. 8, an overall influence situation of flight release is analyzed, which comprises: a total number of flights affected by flow control, a total number of flights restricted by flow control and a ratio of flights restricted by flow control, and the indexes are displayed in a mode of table. For example, a set of influence-type overall efficiency indexes is shown: the total number of flights affected by flow control is 873, the total number of flights restricted by flow control is 746, and the ratio of flights restricted by flow control is 85.45%.

9-4. Analysis of Normalization

As shown in the step 6 of FIG. 1 and in the left area of FIG. 8, the three categories and nine sub-categories of indexes above are normalized to generate dimensionless values, with a range of numerical value of [0, 100], and are displayed in a mode of radar chart. For example, a set of overall efficiency indexes is shown: the stability-type indexes form a dark grey quadrilateral area, the delay-type indexes form a light grey quadrilateral area, and the influence-type indexes form a white quadrilateral area According to the present invention, the multi-dimensional flight release efficiency evaluation and analysis comprising the matching between capacity and flow, the hopping level, the delay distribution, the fairness and the normality are realized, and the evaluation indexes are visually displayed in modes of table, circular histogram, traditional histogram, line chart, radar chart and the like, thus being comprehensive and intuitive. Therefore, a method support for flight release efficiency analysis is provided for the field of civil aviation flight flow management.

The multi-dimensional flight release efficiency evaluation method of the embodiment is loaded and operated in a processing server of an air traffic flow management system (ATFM system) or a corresponding computer of an air traffic control system (ATC system).

In a specific implementation, the present application provides a computer storage medium and a corresponding data processing unit, wherein the computer storage medium is capable of storing a computer program, and the computer program, when executed by the data processing unit, can run the inventive contents of the multi-dimensional flight release efficiency evaluation method provided by the present invention and some or all steps in various embodiments. The storage medium may be a magnetic disk, an optical disk, a Read Only Storage (ROM) or a Random Access Storage (RAM), and the like.

Those skilled in the art can clearly understand that the technical solutions in the embodiments of the present invention can be realized by means of a computer program and a corresponding general hardware platform thereof. Based on such understanding, the essence of the technical solutions in the embodiments of the present invention or the part contributing to the prior art, may be embodied in the form of a computer program, i.e., a software product. The computer program, i.e., the software product is stored in a storage medium comprising a number of instructions such that a device (which may be a personal computer, a server, a singlechip, a MUU or a network device, and the like) comprising the data processing unit executes the methods described in various embodiments or some parts of the embodiments of the present invention.

The present invention provides the multi-dimensional flight release efficiency evaluation method. There are many methods and ways to realize the technical solutions. The above is only the preferred embodiments of the present invention. It should be pointed out that those of ordinary skills in the art can make some improvements and embellishments without departing from the principle of the present invention, and these improvements and embellishments should also be regarded as falling with the scope of protection of the present invention. All the unspecified components in the embodiments can be realized by the prior art.

What is claimed is:

1. A multi-dimensional flight release efficiency evaluation method, comprising a computer readable medium operable on a computer with memory for the multi-dimensional flight release efficiency evaluation method, and comprising program instructions for executing the following steps of:

step 1: parsing and processing operation information;

step 2: identifying a flight object affected by flow control, a flight object restricted by flow control, and a flight object departing from each civil aviation control region according to flight scheduling information;

step 3: analyzing a matching situation between a flight flow and an airspace capacity of a designated airspace object comparatively;

step 4: gathering information about the civil aviation control region as an object to analyze a release time-hopping situation of a flight departing from each control region, which comprises a hopping flight number and a hopping level;

step 5: gathering information about the civil aviation control region as an object to analyze a distribution situation of release delays of the flight departing from each control region, which comprises a maximum delay, a minimum delay, a total delay, a delay flight number and an average delay;

step 6: gathering information about the civil aviation control region as an object to analyze a normal release rate situation of the flight departing from each control region, which comprises a number of normal flights, a number of abnormal flights and a normal rate;

step 7: analyzing a fairness situation of the flight departing from the civil aviation control region, which comprises delay fairness, hopping fairness and fairness under restriction;

step 8: analyzing an overall release efficiency of a controlled flight; and step 9: displaying information related to flight release efficiency evaluations for each control region and controlled flights in each associated control region, wherein the displayed information provides flight flow management of the controlled flights;

wherein the step 1 comprises the following steps of:

step 1-1: parsing flight scheduling basic information (FlightInfo), which comprises a flight call sign (Callsign), a departure airport (DepAirport), a landing airport (DesAirport), a departure region (DepRegion), a scheduled off-block time (Sobt), a scheduled landing time (Sldt), a calculated off-block time (CurCobt) calculated by latest release, a calculated takeoff time (CurCtot) calculated by latest release, a calculated off-block time (LastCobt) calculated by last release, a calculated takeoff time (LastCtot) calculated by last release, a label (Affected) of flight affected by flow control, and a label (Restricted) of flight restricted by flow control; and recording comprehensive information of an $i^{th}$ flight as $FlightInfo_i$;

step 1-2: parsing flight four-dimensional trajectory information Flight4DT={$CrossAirsapce_1$, . . . , $CrossAirsapce_j$}, wherein $CrossAirsapce_j$ is a $j^{th}$ airspace object that the flight passes through, which comprises a name ($AirsapceName_j$) of the airspace object that the flight passes through and a time ($EntreTime_j$) of entering an airspace; and recording the comprehensive information of the $i^{th}$ flight as $Flight4DT_i$; and step 1-3: parsing capacity information (Capacity) of the airspace object needing to be evaluated, which comprises the name (Airsapce) of the airspace object and the airspace capacity (Capacity);

the step 2 comprises the following steps of:

step 2-1: analyzing each flight scheduling basic information (FlightInfo);

step 2-2: when the DepRegion in the traversed flight scheduling basic information is Xinjiang, identifying the flight as a flight object departing from a Xinjiang control region, and putting the flight into a flight set ($FlightSet_1$) departing from the Xinjiang control region; when the DepRegion is Northeast China, identifying the flight as a flight object departing from a northeast control region, and putting the flight into a flight set ($FlightSet_2$) departing from the northeast control region; when the DepRegion is Northwest China, identifying the flight as a flight object departing from a northwest control region, and putting the flight into a flight set ($FlightSet_3$) departing from the northwest control region; when the DepRegion is Southwest China, identifying the flight as a flight object departing from a southwest control region, and putting the flight into a flight set ($FlightSet_4$) departing from the southwest control region; when the DepRegion is East China, identifying the flight as a flight object departing from an East China control region, and putting the flight into a flight set ($FlightSet_5$) departing from the East China control region; when the DepRegion is North China, identifying the flight as a flight object departing from a North China control region, and putting the flight into a flight set ($FlightSet_6$) departing from the North China control region; and when the DepRegion is Central and Southern China, identifying the flight as a flight object departing from a Central and Southern China control region, and putting the flight into a flight set ($FlightSet_7$) departing from the Central and Southern China control region;

step 2-3: analyzing a flight set ($FlightSet_i$) departing from the control region, wherein a value of i ranges from 1 to 7;

step 2-4: analyzing every flight information ($FlightInfo_j$) in a $FlightSet_i$, wherein a value of j ranges from 1 to $N_i$, and $N_i$ represents a total number of flights departing from a corresponding control region;

step 2-5: when the label (Affected) of flight affected by flow control is equal to 1, identifying the flight as the flight object affected by flow control; and when the label (Restricted) of flight restricted by flow control is equal to 1, identifying the flight as the flight object restricted by flow control;

step 2-6: calculating a number ($AffectedNum_i$) of flights departing from the corresponding control region and affected by flow control, wherein when the label (Affected) of flight affected by flow control is equal to 1, $AffectedNum_i$=$AffectedNum_i$+1, and putting the flight information into a flight set (AffectedSet) affected by flow control; and step 2-7: calculating a number ($RestrictedNum_i$) of flights departing from the corresponding control region and restricted by flow control, wherein when the label (Restricted) of flight restricted by flow control is equal to 1, $RestrictedNum_i$=$RestrictedNum_i$+1, and putting the flight information into a flight set (RestrictedSet) restricted by flow control;

the step 3 comprises the following steps of:

step 3-1: parsing set evaluation parameters, which comprise the name (Airsapce) of the evaluated airspace object, an evaluation beginning time (BgnTime), an evaluation time span (TimeSpan), and a number (TimeNum) of evaluation time periods;

step 3-2: dividing the evaluation time periods to generate continuous evaluation time slices, and putting the evaluation time slices into an evaluation time slice set TimeSpanSet={$BT_1$,$ET_1$), . . . , $BT_i$,$ET_i$)}, i∈[1, TimeNum], wherein $BT_i$=BgnTime+TimeSpan*(i−1) represents a beginning time of an $i^{th}$ evaluation time slice; and $ET_i$=BgnTime+TimeSpan*i represents an ending time of the $i^{th}$ evaluation time slice;

step 3-3: extracting time period capacity information of the airspace object needing to be evaluated from the parsed capacity information (Capacity) of the airspace object needing to be evaluated to obtain an airspace capacity ($C_i$) of the $i^{th}$ time slice;

step 3-4: analyzing $CrossAirsapce_j$ in the flight four-dimensional trajectory information;

step 3-5: when AirsapceName=Airsapce, allowing that $EntreTime_j$∈$BT_i$,$ET_i$), which represents that the name of the airspace object that the flight passes through is the same as the airspace object needing to be evaluated, and when the time of entering the airspace is within beginning and ending time periods of the time slice, allowing that $Flow_i$=$Flow_i$+1, wherein $Flow_i$ represents a predicted flow of the $i^{th}$ evaluation time slice; and step 3-6: after obtaining the predicted airspace flow of each time slice, comparing a matching situation between the predicted flow and the airspace capacity, and calculating an overflow operation level ($OverFlowLv_i$) of each time slice, wherein:

$$OverFlowLv_i = \begin{cases} -1, Flow_i \in -\infty, 0.8*C_i) \text{ and } C_i \neq 0 \\ 0, Flow_i \in 0.8*C_i, C_i) \text{ and } C_i \neq 0 \\ 1, Flow_i \in C_i, 1.1*C_i) \text{ and } C_i \neq 0 \\ 2, Flow_i \in 1.1*C_i, 1.2*C_i) \text{ and } C_i \neq 0 \\ 3, Flow_i \in 1.2*C_i, +\infty) \text{ and } C_i \neq 0 \\ \Phi, \text{others} \end{cases};$$

the step 4 comprises the following steps of:

step 4-1: analyzing the flight set ($FlightSet_i$) departing from each civil aviation control region;

step 4-2: analyzing every flight information ($FlightInfo_j$) in the $FlightSet_i$;

step 4-3: when the flight satisfies that CurCtot−LastCtot∈(−∞,−$VSP_1$], allowing that $ChangeLv1Num_i$=$ChangeLv1Num_i$+1; when the flight satisfies that CurCtot−LastCtot∈(−$VSP_1$,0), allowing that $ChangeLv2Num_i$=$ChangeLv2Num_i$+1; when the flight satisfies that CurCtot−LastCtot∈(0,$VSP_1$], allowing that $ChangeLv3Num_i$=$ChangeLv3Num_i$+1; and when the flight satisfies that CurCtot−LastCtot∈($VSP_1$+∞), allowing that $ChangeLv4Num_i$=$ChangeLv1Num_i$+1; wherein CurCtot−LastCtot represents a difference of calculated take-off time calculated by two latest releases, $ChangeLv1Num_i$ represents a number of flights with a hopping level 1 of the $i^{th}$ control region, $ChangeLv2Num_i$ represents a number of flights with a hopping level 2 of the $i^{th}$ control region, $ChangeLv3Num_i$ represents a number of flights with a hopping level 3 of the $i^{th}$ control region, $ChangeLv4Num_i$ represents a number of flights with a hopping level 4 of the $i^{th}$ control region, and $VSP_1$ represents a hopping level interval threshold;

step 4-4: calculating a total hopping number ($ChangeNum_i$) of the flights departing from the corresponding control region, wherein $ChangeNum_i$=$ChangeLvlNum_i$+$ChangeLv2Num_i$+$ChangeLv3Num_i$+$ChangeLv4Num_i$; and step 4-5: calculating a total hopping amount ($ChangeTotal_i$) of the flights departing from the corresponding control region, wherein $$ChangeTotal_i = \sum_{j=1}^{N_i} |CurCtot - LastCtot|;$$

the step 5 comprises the following steps of:

step 5-1: analyzing the flight set ($FlightSet_i$) departing from each civil aviation control region;

step 5-2: analyzing every flight information ($FlightInfo_j$) in the $FlightSet_i$;

step 5-3: calculating a delay number ($DelayNum_i$) of the flights of the corresponding control region, wherein when $CurCobt_j$−$Sobt_j$>0, $DelayNum_i$=$DelayNum_i$+1, which represents that when the calculated off-block time of the flight departing from the control region is greater than the scheduled off-block time, the flight is a delayed flight of the control region, and $CurCobt_j$−$Sobt_j$ represents a delay amount of the flight;

step 5-4: initializing that $DelayMax_i$=0, and calculating a maximum delay ($DelayMax_i$) of the flights of the corresponding control region, wherein when $CurCobt_j$−$Sobt_j$>$DelayMax_i$, $DelayMax_i$=$CurCobt_j$−Sobt, which is also denoted as:

$$DelayMax_i = MAX(DelayMax_i, CurCobt_j - Sobt_j, 0);$$

step 5-5: initializing that $DelayMin_i$=0, and calculating a minimum delay ($DelayMin_i$) of the flights of the corresponding control region, wherein when $CurCobt_j$−$Sobt_j$<$DelayMin_i$, $DelayMin_i$=$CurCobt_j$−Sobt, which is also denoted as:

$$DelayMin_i = Min(DelayMin_i, Max(CurCobt_j - Sobt_j, 0));$$

step 5-6: calculating a total delay ($DelayTotal_i$) of the flights of the corresponding control region, which represents a sum of delays of the flights of the control region, wherein:

$$DelayTotal_i = \sum_{j=1}^{N_i} MAX(CurCobt_j - Sobt_j, 0);$$

and step 5-7: calculating an average delay ($DelayAve_i$) of the flights of the corresponding control region, which represents an average delay amount of the flights of the control region, wherein:

$$DelayAve_i = \begin{cases} DelayTotal_i / DelayNum_i, DelayNum_i \neq 0 \\ 0, DelayNum_i = 0 \end{cases};$$

the step 6 comprises the following steps of:

step 6-1: analyzing the flight set ($FlightSet_i$) departing from each civil aviation control region;

step 6-2: analyzing every flight information ($FlightInfo_j$) in the $FlightSet_i$;

step 6-3: calculating a number ($NormalNum_i$) of normal flights departing from the $i^{th}$ control region, wherein when $CurCobt_j$−$Sobt_j$∈(−∞,$VSP_2$], $NormalNum_i$=$NormalNum_i$+1, which represents that flights with a flight delay no greater than $VSP_2$ are the normal flights;

step 6-4: calculating a number ($UnNormalNum_i$) of abnormal flights, wherein when $CurCobt_j$−$Sobt_j$∈($VSP_2$,+∞), $UnNormalNum_i$=$UnNormalNum_i$+1, which represents that flights with a flight delay greater than $VSP_2$ are the abnormal flights; and step 6-5: after finishing analyzing the flights, calculating a normal rate ($NormalRate_i$) of the flights departing from the corresponding control region, which represents a ratio of the normal flights in the flights departing from the control region, wherein $NormalRate_i$=$NormalNum_i$/$N_i$;

the step 7 comprises the following steps of:

step 7-1: calculating an average value (DelayAveAve) of the average delay of the flights departing from each control region, wherein:

$$DelayAveAve = \sum_{i=1}^{7} DelayAve_i / 7;$$

step 7-2: calculating a delay fairness index (DelayFairness), which represents a standard deviation of the average delay of the flights departing from each control region, wherein:

$$DelayFairness = \sqrt{\sum_{i=1}^{7}(DelayAve_i - DelayAveAve)^2 / 6};$$

step 7-3: calculating an average hopping amount (ChangeAve) of the flights departing from each control region, wherein:

$$ChangeAve = \sum_{i=1}^{7} ChangeTotal_i / 7;$$

step 7-4: calculating a hopping fairness index (ChangeFairness), which represents a standard deviation of the hopping amount of the flights departing from each control region, wherein:

$$ChangeFairness = \sqrt{\sum_{i=1}^{7}(ChangeTotal_i - ChangeAve)^2 / 6};$$

step 7-5: calculating an average number (RestrictedAve) of the flights departing from each control region and restricted by flow control, wherein:

$$RestrictedAve = \sum_{i=1}^{7} RestrictedNum_i / 7;$$

and step 7-6: calculating a restricted fairness index (RestrictedFairness), which represents a standard deviation of the number of the flights departing from each control region and restricted by flow control, wherein:

$$RestrictedFairness = \sqrt{\sum_{i=1}^{7}(RestrictedNum_i - RestrictedAve)^2 / 6};$$

the step 8 comprises the following steps of:

step 8-1: calculating a total hopping flight number (ChangeNum), which represents a number of flights in all flights with different calculated off-block time calculated by two adjacent releases, wherein $$ChangeNum = \sum_{i=1}^{7} ChangeNum_i;$$

step 8-2: calculating a total hopping amount (ChangeTotal) of the flights, which represents a cumulative absolute difference of the calculated off-block time calculated by two adjacent releases of all flights, wherein $$ChangeNum = \sum_{i=1}^{7} ChangeTotal_i;$$

step 8-3: calculating an average hopping amount (ChangeTotalAve) of the flights, which represents an average absolute difference of the calculated off-block time calculated by two adjacent releases of all flights, wherein:

$$ChangeTotalAve = \begin{cases} ChangeTotal / ChangeNum, & ChangeNum \neq 0 \\ 0, & ChangeNum = 0 \end{cases};$$

step 8-4: calculating a total delay flight number (DelayNum), which represents a number of flights in all flights with the calculated off-block time later than the scheduled off-block time, wherein $$DelayNum = \sum_{i=1}^{7} DelayNum_i;$$

step 8-5: calculating a total delay amount (DelayTotal) of the flights, which represents a cumulative absolute difference of all flights with the calculated off-block time later than the scheduled off-block time, wherein $$DelayTotal = \sum_{i=1}^{7} DelayTotal_i;$$

step 8-6: calculating an average delay amount (DelayTotalAve) of the flights, which represents an average difference of all flights with the calculated off-block time later than the scheduled off-block time, wherein:

$$DelayTotalAve = \begin{cases} DelayTotal / DelayNum, & DelayNum \neq 0 \\ 0, & DelayNum = 0 \end{cases};$$

step 8-7: calculating a total number (AffectedNum) of flights affected, which represents a number of flights affected by flow control, wherein:

$$AffectedNum = \sum_{i=1}^{7} AffectedNum_i;$$

step 8-8: calculating a total number (RestrictedNum) of flights restricted, which represents a number of flights restricted by flow control, wherein:

$$RestrictedNum = \sum_{i=1}^{7} RestrictedNum_i;$$

step 8-9: calculating a ratio (RestrictedRato) of flights restricted, which represents a ratio of flights restricted by flow control, wherein:

$$RestrictedRato = RestrictedNum \Big/ \sum_{i=1}^{7} N_i;$$

and step 8-10: normalizing the total hopping flight number (ChangeNum), the total hopping amount (ChangeTotal) of the flights, the average jumping amount (ChangeTotalAve) of the flights, the total delay flight number (DelayNum), the total delay amount (DelayTotal) of the flights, the average delay amount (DelayTotalAve) of the flights, the total number (AffectedNum) of the flights affected, the total number (RestrictedNum) of the flights restricted and the ratio (RestrictedRato) of the flights restricted, and analyzing an overall efficiency index by using a radar chart.

* * * * *